United States Patent [19]

Kampichler et al.

[11] Patent Number: 4,611,566

[45] Date of Patent: Sep. 16, 1986

[54] FUEL INJECTION PUMP FOR INTERNAL COMBUSTION ENGINES

[75] Inventors: Günter Kampichler, Ruhstorf; Karl Rapp, Stuttgart, both of Fed. Rep. of Germany

[73] Assignee: Robert Bosch GmbH, Stuttgart, Fed. Rep. of Germany

[21] Appl. No.: 683,300

[22] Filed: Dec. 18, 1984

[30] Foreign Application Priority Data

Dec. 29, 1983 [DE] Fed. Rep. of Germany ..... 3347430

[51] Int. Cl.[4] ..... F02M 39/00

[52] U.S. Cl. ..... 123/506; 123/504; 417/499

[58] Field of Search ..... 123/504, 506, 501, 500, 123/495; 417/494, 499

[56] References Cited

U.S. PATENT DOCUMENTS

| | | | |
|---|---|---|---|
| 2,356,511 | 8/1944 | Descourtis | 417/494 |
| 2,696,786 | 12/1954 | Fleck et al. | 417/499 |
| 3,123,006 | 3/1964 | Partridge | 417/499 |
| 3,435,811 | 4/1969 | Guertler | 123/506 |
| 3,990,413 | 11/1976 | Pischinger | 417/499 |
| 4,163,634 | 8/1979 | Powers | 417/499 |

FOREIGN PATENT DOCUMENTS

| | | | |
|---|---|---|---|
| 677324 | 8/1952 | United Kingdom | 123/504 |

*Primary Examiner*—Carl Stuart Miller
*Attorney, Agent, or Firm*—Edwin E. Greigg

[57] ABSTRACT

In a fuel injection pump for internal combustion engines, a leakage connection is provided for varying the fuel supply quantity and the supply onset in accordance with rpm. The leakage connection, in a pump piston executing the stroke movement, is effective only at the beginning of the supply stroke of the pump piston and becomes gradually less effective in stages in the middle rpm range. The leakage connection has an outer groove in the pump piston, a blind bore discharging in the piston end face, and at least one throttle bore connecting the blind bore with the bore bottom of the outer groove. The outer groove extends over only a portion of the circumference of the pump piston and parallel to the piston end face at a very small distance therefrom.

2 Claims, 3 Drawing Figures

FUEL INJECTION PUMP FOR INTERNAL COMBUSTION ENGINES

BACKGROUND OF THE INVENTION

The invention relates to a fuel injection pump for internal combustion engines as disclosed hereinafter In fuel injection it is advantageous for the supply quantity or injection quantity to be reduced and for the supply onset to begin later in the lower rpm range of the engine as compared with what is required at higher rpm. To this end, in a known fuel injection pump (Swiss Patent No. 269 597) a leakage connection between the pump work chamber and the inflow opening is provided which is effective for the first portion of the supply stroke that immediately follows the intake stroke of the pump piston. During this portion of the supply stroke, fuel flows back into the inflow opening via this leakage connection. The actual supply stroke of the pump piston, in which the aspirated fuel quantity is delivered under pressure to an injection nozzle, thus begins only after the leakage connection is closed. The supply and injection quantity is thus decreased in accordance with the returned fuel quantity. It is readily apparent that at low engine rpm and thus at a slow pump piston stroke speed, this effect is greater than at higher piston stroke speeds. In the upper rpm range, the leakage connection has virtually no effect.

In the known fuel injection pump, the leakage connection comprises an annular groove extending about the circumference of the piston and disposed in a manner that is spaced apart from and parallel to the piston end face defining the pump work chamber. The annular groove communicates with the pump work chamber via an axially extending leakage hole, so the leakage connection is closed only once the pump piston has moved so far upward that the annular groove is located with its upper control edge above the inflow opening in the cylinder bushing.

Because of the leakage hole, which penetrates the groove flank, the annular groove must be made relatively, deep. Since the annular groove must also be disposed relatively close to the end face of the piston, an outwardly projecting overhang or rim, which is not very thick, is accordingly formed on the outer rim of the piston end face that is exposed to high pressure; however, this rim cannot offer sufficient resistance, over a long period of time, to the pressure imposed on it. The result is a fuel injection pump with a short service life, because material fatigue sets in quickly.

OBJECT AND SUMMARY OF THE INVENTION

The fuel injection pump according to this invention has the advantage over the prior art that the outer groove can be made very flat, because the throttle bore discharges into the bottom of the groove. Furthermore, since the groove must extend over only a small portion of the piston circumference, no notable weakening of the piston surface exposed to pressure occurs. The calibrated throttle bore can be drilled in the same advantageous manner as the injection ports of the injection nozzles, so that the range of deviation within one series of mass produced pumps is very small.

Further, advantageous embodiments of the invention are disclosed in the application and for reasons of fluid mechanics, a disposition of two throttle bores in accordance with the teaching herein is preferred.

An advantageous embodiment of the invention is also disclosed herein. The distance between the lower edge of the groove and the end face of the piston determines the shift of the supply onset, which is fixed in degrees of camshaft angle with respect to the cam drive of the pump piston. At the same time, the theoretical reduction or adaptation of the supply quantity is ascertained thereby, that is, by the product of the above-mentioned distance and the size of the piston end face. This applies to the lower rpm range. As the piston speed increases with increasing engine rpm, the flow resistance in the calibrated throttle bore increases, causing the supply quantity to increase while the supply onset is simultaneously shifted toward "early". Beyond a predetermined speed of the pump piston, the flow resistance in the throttle bore is so great that there is no longer any perceptible influence on the part of the leakage connection. The supply quantity and supply onset are then determined solely by the area of the control surface.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
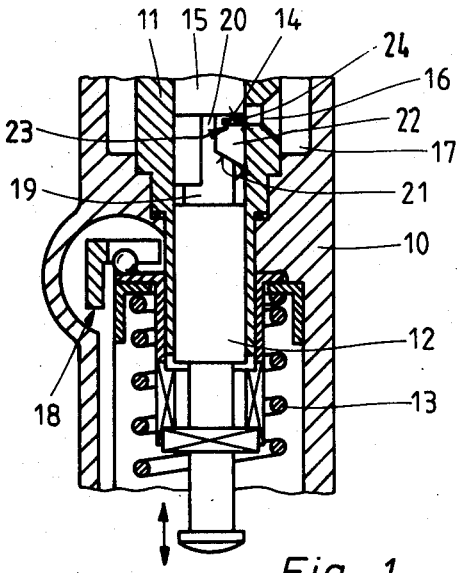
FIG. 1 is a detail of a longitudinal section taken through a fuel injection pump.

In the fuel injection pump, a detail of which is shown in longitudinal section in FIG. 1, a cylinder bushing 11 is inserted into a housing 10. A pump piston 12 which is moved axially back and forth by the cooperation of a cam (not shown) and a compression spring 13 is guided in the cylinder bushing 11. The drive speed of the pump piston 12 is synchronized with the rpm of the internal combustion engine or motor. The end face 14 of the pump piston 12, together with the cylinder bushing 11, encloses a pump work chamber 15, the outlet (not shown) of which typically communicates with an injection nozzle for one cylinder of the engine.

In order to fill the pump work chamber 15 with fuel, an inflow opening 16 is provided in the cylinder bushing 11; this opening 16 serves as both an inlet and a return-flow opening and connects the pump work chamber 15 with a fuel-filled annular chamber 17. For adjusting the supply quantity of the fuel injection pump, a supply quantity adjusting member 18 is provided on the one hand, for adjusting the rotation of the pump piston 12, and on the other hand the pump piston 12 is provided, on its section oriented toward the pump work chamber 15, with a circumferential groove 19, which by means of a longitudinal groove 20 is in continuous communication with the pump work chamber 15. The longitudinal groove 20 is defined by a control edge 21 of a control face 22, the edge 21 extending obliquely over the circumference of the pump piston 12. The control face 22 closes the inflow opening 16 during the so-called supply stroke of the pump piston 12, in which the fuel present in the pump work chamber 15 is delivered to the injection nozzle. The effective supply stroke of the pump piston 12 is terminated as soon as the oblique control edge 21 reaches the inflow opening 16, and thus as the piston stroke continues the circumferential groove 19 is in communication with the inflow opening 16. The fuel positively displaced from the pump work chamber in this portion of the piston stroke flows back into the annular chamber 17 of the injection pump via the longitudinal groove 20, the circumferential groove 19 and the inflow opening 16. To vary the supply quantity of the injection pump, the pump piston 12 is rotated in the circumferential direction by the supply quantity adjusting member 19, so that the axial length of the control face 22 varies depending on the rotational direction, and the supply quantity is accordingly increased or decreased.

Figure 2:
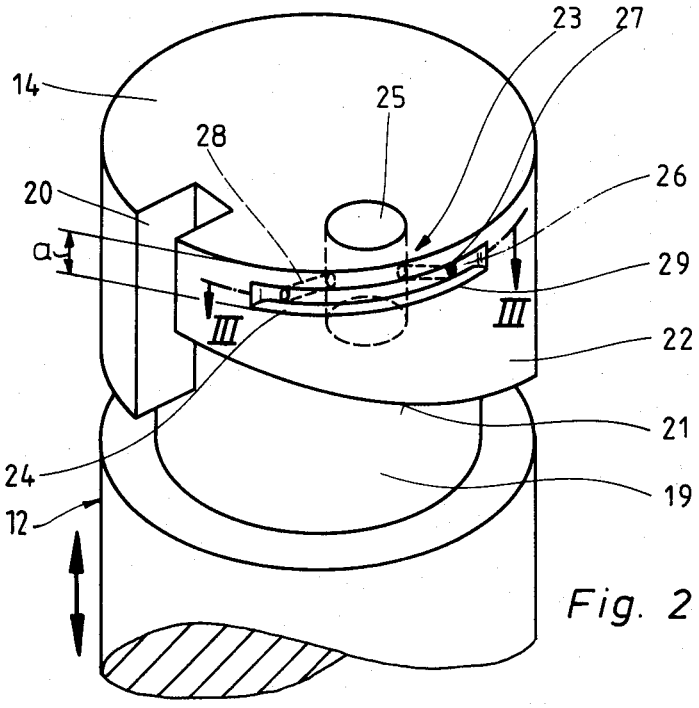
FIG. 2 is a perspective view of a detail of a pump piston of the fuel injection pump of FIG. 1.

To attain an rpm-dependent adaptation of the supply quantity and the supply onset, a leakage connection 23 is provided between the pump work chamber 15 and the inflow opening 16, this connection 23 being effective only at the beginning of the supply stroke of the pump piston 12, and by way of which a portion of the fuel present in the pump work chamber 15 is capable of returning via the inflow opening 16 (FIG. 2). The leakage connection 23 comprises a groove 24 extending in the cylindrical surface of the pump piston 12, or in other words in the control face 22, parallel to the end face 14 of the piston; a blind bore 25 discharging into the piston end face 14; and two calibrated throttle bores 27, 28 connecting the blind bore 25 with the bottom 26 of the groove 24. The groove 24 extends in a manner which is spaced apart from the longitudinal groove 20 over at least a portion of the adjustment travel of the pump piston 12. A distance a between a lower edge 29 of the groove 24 and the end face 14 of the piston 12 is defined to very small tolerances. This distance a results in a shift of the supply onset toward "late", and also, when multiplied by the area of the piston end face 14, determines the magnitude of the reduction in the supply quantity. The distance a should thus be dimensioned in accordance with the desired timing shift of the supply onset relative to the closure of the inflow opening 16 by the control face 22 of the pump piston 12 when the piston speed is relatively low.

Figure 3:
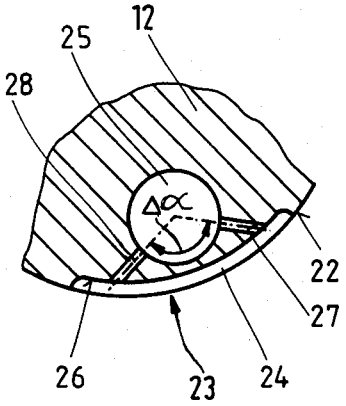
FIG. 3 is a detail view of a cross section of the pump piston taken along the line III—III of FIG. 2.

The two throttle bores 27, 28 are disposed at a predetermined angular spacing $\Delta\alpha$ from one another, symmetrically to the middle of the longitudinal extension of the groove 24, and are disposed together with the groove 24 in a common cross-sectional plane of the pump piston 12 (FIGS. 2 and 3). Their diameter in the exemplary embodiment is substantially 0.22 mm. The throttle bores 27, 28 are drilled in the same manner as the known injection ports of the injection nozzles, so the deviation from one pump to another in a mass-produced series can be kept very slight.

OPERATION

The mode of operation of this leakage connection 23 is as follows:

At bottom dead center of the pump piston 12, the end face 14 of the pump pistion 12 is located below the inflow opening 16 in the cylindrical bushing 11. The pump work chamber 15, the circumferential groove 19 and the longitudinal groove 20 are all filled with fuel. As soon as the inflow opening 16 is closed by the control face 22 during the upward movement of the pump piston 12, the supply stroke of the pump piston 12 begins. Initially during the piston movement, fuel flows back to the inflow opening 16 via the blind bore 25 discharging into the piston end face 14, the two throttle bores 27, 28 and the groove 24. This continues until such time as the lower edge 29 of the groove 24 is located above the inflow opening 16, which occurs after a further movement of the pump piston 12. Then the inflow opening 16 is again closed, without interruption, by the control face 22, and the actual supply stroke of the pump piston 12 begins. The supply onset depends upon the time the pump piston 12 requires to traverse the distance a in the stroke direction after the closure of the inflow opening 16 by the control face 22. It will be appreciated that with increasing piston speed, the supply onset will be advanced. The reduction of the supply quantity, at very low piston speed, corresponds to the volume resulting from the multiplication of the area of the piston end face 14 and the distance a. This volume is further dependent on the flow resistance in the throttle bores 27, 28, which at the slowest piston speed is negligibly small. With increasing piston speed, the flow resistance in the throttle bores 27, 28 increases, so that the reduction of the supply quantity through the leakage connection 23 lessens as the engine speed increases. In other words, a larger supply quantity is delivered to the injection nozzle or to the cylinder of the engine. At high engine speed, the flow resistance in the throttle bores 27, 28 is so great that the leakage connection 23 has no effect.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a pump piston, said pump piston including an end face and a circumference, said pump piston being guided in a cylinder bushing arranged to supply fuel from a pump work chamber defined by the pump piston, said cylinder bushing comprising a fuel inflow opening therein, a control face including an oblique control edge on the circumference of said pump piston arranged to define an at least partial circumferential groove in said pump piston, the relative location of the control edge with respect to the inflow opening adapted to determine the opening and closing of the inflow opening, said at least partial circumference groove being located below said control face in a stroke direction, a longitudinal passage which extends from said end face of said piston to said at least partial circumferential groove in said piston, a leakage connection positioned between the pump work chamber and the inflow opening, said leakage connection arranged to be effective at the beginning of a pump piston supply stroke, said leakage connection having a groove means extending along a portion of the circumference of said pump piston in said control face of said pump piston parallel to and spaced apart by a short distance from an end face of said piston which defines said pump work chamber, said leakage connection including a blind bore arranged to discharge in said piston end face and a plurality of throttle bores disposed at an angular distance ($\Delta\alpha$) from one another which connect said blind bore with the bottom of said groove means, wherein said groove means includes a lower edge portion remote from said piston end face and wherein the distance from said piston end face to said lower edge portion of said groove means being dimensioned in accordance with a desired timing shift of supply onset with respect to closing of said inflow opening at low rpm, and said groove means and said at least one throttle bore extend in the same cross-sectional plane of said pump piston.

2. A fuel injection pump for internal combustion engines having a pump piston, said pump piston including an end face and a circumference, said pump piston being guided in a cylinder bushing arranged to supply fuel from a pump work chamber defined by the pump piston, said cylinder bushing comprising a fuel inflow opening therein, a supply quantity adjusting member for adjusting the rotation of said pump piston with respect to said inflow opening, a control face including an oblique control edge on the circumference of said pump piston arranged to define an at least partial circumferential groove in said pump piston, the relative location of the control edge with respect to the inflow opening adapted to determine the opening and closing of the inflow opening, said at least partial circumferential groove being located below said control face in a stroke direction, a longitudinal passage which extends from said end face of said piston to said at least partial circumferential groove in said piston, a leakage connection positioned between the pump work chamber and the inflow opening, said leakage connection arranged to be effective at the beginning of a pump piston supply stroke, said leakage connection having a groove means extending along a portion of the circumference of said pump piston in said control face of said pump piston parallel to and spaced apart by a short distance from an end face of said piston which defines said pump work chamber, said groove means being spaced apart from said longitudinal passage and extends over at least a portion of the rotational adjustment travel of said pump piston, said leakage connection including a blind bore arranged to discharge in said piston end face and at least one throttle bore which connects said blind bore with the bottom of said groove means, wherein said groove means includes a lower edge portion remote from said piston end face and wherein the distance from said piston end face to said lower edge portion of said groove means being dimensioned in accordance with a desired timing shift of supply onset with respect to closing of said inflow opening at low rpm, and said groove means and said at least one throttle bore extend in the same cross-sectional plane of said pump piston.

* * * * *